US005440292A

United States Patent [19]

Bedrosian

[11] Patent Number: 5,440,292

[45] Date of Patent: Aug. 8, 1995

[54] INTRUSION DETECTOR

[75] Inventor: Bert S. Bedrosian, Scottsdale, Ariz.

[73] Assignee: Guard-Tech Industries, Inc., Scottsdale, Ariz.

[21] Appl. No.: 262,572

[22] Filed: Jun. 20, 1994

[51] Int. Cl.[6] ..... G08B 13/18

[52] U.S. Cl. ..... 340/567; 340/565; 340/531; 340/539

[58] Field of Search ..... 340/552, 567, 693, 533, 340/539, 691, 528, 531, 825.1, 825.17, 825.18

[56] References Cited

U.S. PATENT DOCUMENTS

| | | | |
|---|---|---|---|
| 3,969,709 | 7/1976 | Isaacs et al. | 340/528 |
| 4,342,987 | 8/1982 | Rossin | 340/567 |
| 4,446,454 | 5/1984 | Pyle | 340/533 |
| 4,742,336 | 5/1988 | Hall et al. | 340/539 |
| 4,930,864 | 6/1990 | Kuster et al. | 340/567 |
| 4,943,799 | 7/1990 | Papineau | 340/531 |
| 5,089,704 | 2/1992 | Perkins | 250/342 |
| 5,283,549 | 2/1994 | Mehaffey et al. | 340/531 |

*Primary Examiner*—Brent Swarthout
*Assistant Examiner*—Benjamin C. Lee
*Attorney, Agent, or Firm*—Gifford, Krass, Groh, Sprinkle, Patmore, Anderson & Citkowski

[57] ABSTRACT

An intrusion detector employing a remote, 360° infrared detector. The detector includes a base unit with a receiver, controller, digital dialer and power supply plug, a remote sensor which is adjustable along a vertical axis and includes a 360° infrared motion sensor, and a hand held remote control unit to arm and disarm the base unit. The remote sensor may be selectively positioned to detect movement in a surrounding area definable by the user.

20 Claims, 2 Drawing Sheets

INTRUSION DETECTOR

FIELD OF THE INVENTION

This invention relates to the field of portable of self-contained intrusion detectors, and more particularly, to such a detector employing a remote unit including a 360° infrared sensor and adjustable along a vertical axis, and a base unit including a dialer and a controller programmed to dial a preselected telephone number upon the detection of any intrusion.

DESCRIPTION OF THE RELEVANT PRIOR ART

A variety of portable or self-contained intrusion detectors are known in the prior art. For example, U.S. Pat. No. 4,742,336 discloses a portable detector housed within a brief case. The brief case is provided with hinges and latching elements, as well as a lock to open the case. Remote sensing units are removable from the brief case, which also contains connecting electrical cords for standard power outlets and telephone lines.

U.S. Pat. No. 4,943,799 discloses a portable alarm system which includes a compact, portable sealed housing having an electronic alarm control circuit therein. The housing is connectable to an AC power supply outlet, and also includes a telephone jack which connects a telephone circuit to a dialer circuit within the control circuit of the alarm. The device includes a digital keypad secured to the housing, as well as plurality of switches on the exterior of the housing whereby the user can program the control circuit. The device also includes a receiver circuit in the housing. One or more wireless infrared detectors are detachably secured to the housing. They may be positioned to detect moving objects. The detectors include infrared transmitters of different frequencies which transmit alarm signals to the receiver. The receiver has a plurality of channels in order to recognize the plurality of infrared detectors. The device also includes an audible alarm. Except for the digital dialer and exterior switches, all of the electronics are located within a sealed housing and cannot be tampered with by either authorized or unauthorized users.

While such prior art systems are useful in certain situations, they suffer from certain disadvantages. In particular, the remote sensing units are rudimentary and can be used to sense intrusion in a relatively limited volume of space. In particular, these remote sensing units are unidirectional and lack selectivity; that is, the volume of space which they monitor can be adjusted only by repositioning the entire unit.

Clearly, there is a need for an intrusion detector which can be easily adjusted to monitor a particular volume of space. There is also a need for such a system which has remote detectors which can detect intrusion in 360° of space around them. Further, there is a need for such a system wherein certain portions of the volume of space monitored by the detectors can be selectively masked so as to eliminate false alarms caused by anticipated activities of the user.

SUMMARY OF THE INVENTION

The present invention has been designed to overcome the deficiencies in the prior art noted above. The invention is an intrusion detector which consists of three main elements: a base unit; at least one remote detector; and a hand held remote control unit. The base unit includes an electromagnetic wave receiver (typically for the receipt of either microwave or radio wave energy), a phone jack connected to a digital dialer, an external power supply plug, and a programmable controller in communication with the receiver, phone jack, dialer and power plug.

Each remote sensor includes a base having an upwardly extending first neck portion and a spherical sensor head having a downwardly depending second neck portion for telescopic connection with the first neck portion. Each sensor also includes an electromagnetic wave transmitter for communication with the base unit. A 360° infrared motion sensor is disposed in the spherical sensor head and is in electrical communication with the transmitter. Means are provided for fixing the relative position of the telescopic first and second neck portions such that the height of the sensor head may be adjusted along a vertical axis.

The remote control unit is a portable, hand held unit which also has an electromagnetic wave transmitter for communication with the base unit. The remote control is used to input various signals to the base unit, such as an arming signal, a disarming signal, or an alarm signal. Thus, the remote control unit can, independently of the activity of the detectors, activate the base unit in case of an emergency situation.

When it is activated either by the remote control unit, or by activation of the infrared sensors, the controller of the base unit is programmed to dial a preselected phone number. This preselected phone number may be the number of the local police department or other law enforcement units, or it may be the phone number of a private security system.

The base unit may further include an audible alarm which sounds whenever the base unit is activated. The base unit may also include a display including a plurality of LEDs which, when lit, indicate that various functions of the base unit are operative. In particular, when a plurality of remote sensors are employed, a respective LED associated with a particular remote sensor may light up when the sensor senses an intrusion so that the user will know in which area the intrusion is occurring.

In the embodiment employing multiple remote sensors, the transmitter of each remote sensor transmits at a different frequency. Thus, the receiver of the base unit will have several channels, each channel responsive to the frequency of a remote sensor. The control of the base unit is further programmed to determine which remote sensor is active depending on which channel of the receiver is active, and light up the appropriate LED on the display.

In another embodiment of the detector of the present invention, each spherical sensor head includes a band extending around its circumference which is transmissive to infrared radiation. Disposed inside the sensor head is a frustoconical mirror having a plurality of planar reflective surfaces radially arrayed around its surface. The frustoconical mirror is aligned with the infrared transmissive band such that infrared radiation coming from any radial direction will fall upon one or more of the planar surfaces. Disposed above the frustoconical mirror is a concave mirror upon which the infrared radiation reflected from the plurality of planar surfaces falls. The concave shape of the mirror causes the reflected radiation to focus at the center of the concave mirror. An infrared sensor is disposed below the center of the concave mirror and, preferably, at the top of the frustoconical mirror such that radiation concentrated and reflected by the concave mirror will fall onto the sensor. The sensor will then send an electronic signal to the transmitter of the detector, causing the transmitter to broadcast at the appropriate frequency.

Preferably, a collar made of infrared transmissive material is disposed on the sensor head so that it overlies the infrared transmissive band. The collar serves to enclose and conceal the internal parts of the sensor head. A plurality of masking elements are provided which may be attached to the sensor head so that they overlie portions of the collar. The masking elements are formed of an infrared blocking material so that infrared radiation from a particular portion of space which would otherwise be received by the infrared sensor will be blocked. This feature is useful in cases where the remote sensor is placed in an environment in which regular activity takes place in a particular quadrant or section of the environment. For example, if the remote sensor is in the bedroom of the user, the masking elements can be used to block off infrared radiation from the area of the bed so that the user's normal nighttime activity will not trigger the intrusion detector.

BRIEF DESCRIPTION OF THE DRAWINGS

The present invention may best be understood by reference to the following drawings, in which.

DETAILED DESCRIPTION OF THE PREFERRED EMBODIMENTS

Figure 1:
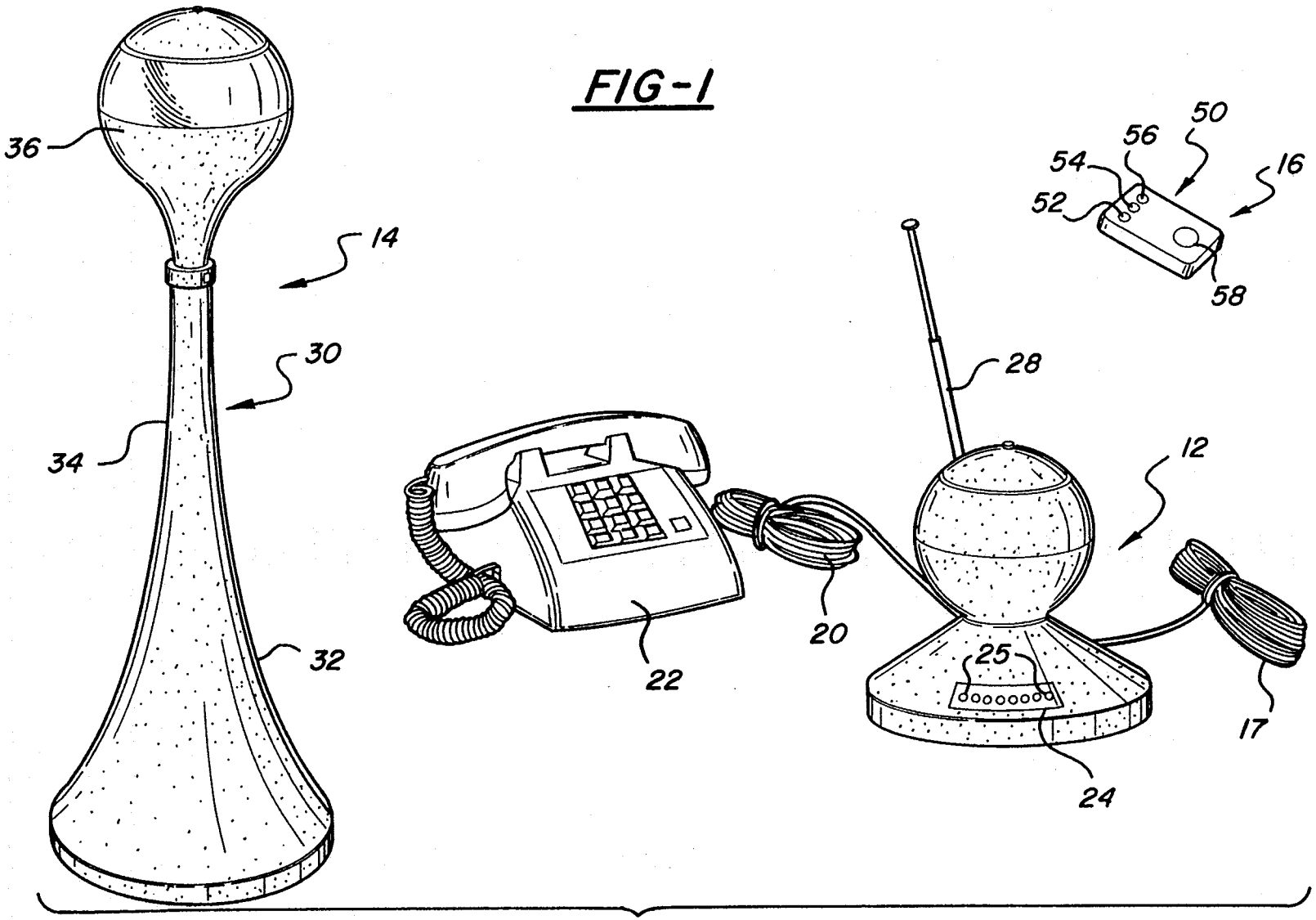
FIG. 1 is a perspective view of an embodiment of the intrusion detector of the present invention showing the base unit, one remote sensor with its sensor head in a lowered position, and the remote control unit.
Figure 4:
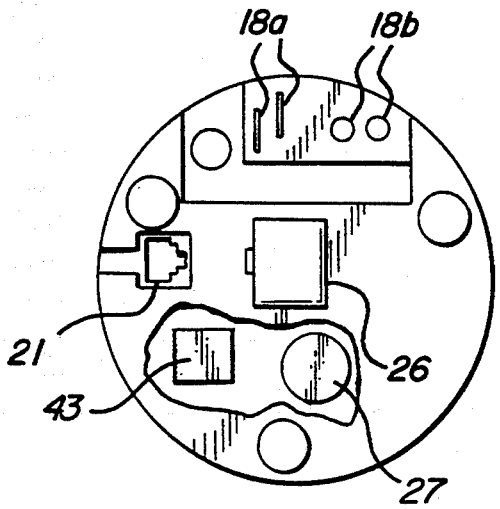
FIG. 4 is a bottom view of the base unit showing certain switches and other structures.

Throughout the following detailed description, like numerals are used to reference elements of the present invention shown in multiple figures thereof. Referring now to the drawings, and in particular to FIG. 1, there is shown an intrusion detector 10 constructed according to the present invention. The detector 10 includes a base unit 12, one remote sensor 14, and a remote control unit 16. The base unit includes an external power supply cord 17, a telephone jack cord 20, for connection to conventional telephone 22, a display 24 having a plurality of LEDs 25, a radio receiver and antenna 28, and, as can be most clearly seen in FIG. 4, a programmable controller 43, audible alarm 27, and a plurality of switches **18*a*–18*b*** which are in communication with said controller. The operation of the base unit and the various switches will subsequently be explained in greater detail below.

The remote sensor 14 includes a sensor base 32 having an upwardly extending first neck portion 34 and a spherical sensor head 36 having a downwardly depending second neck portion 38. As can most clearly be seen in FIG. 2, the second neck portion 38 is telescopically received by the first neck portion 34 so that the vertical height of the sensor head 36 may be adjusted along the vertical axis by extending second neck portion 38 from first neck portion 34. In FIG. 1, the sensor 14 is shown with the sensor head 36 in its lowest position, and in FIG. 2 the sensor head is shown extended into its highest position. Thus, considerable vertical adjustability is permitted by the construction of the present invention. Means 40 for fixing the relative positions of the first and neck portions 34, 38 are provided.

Figure 3:
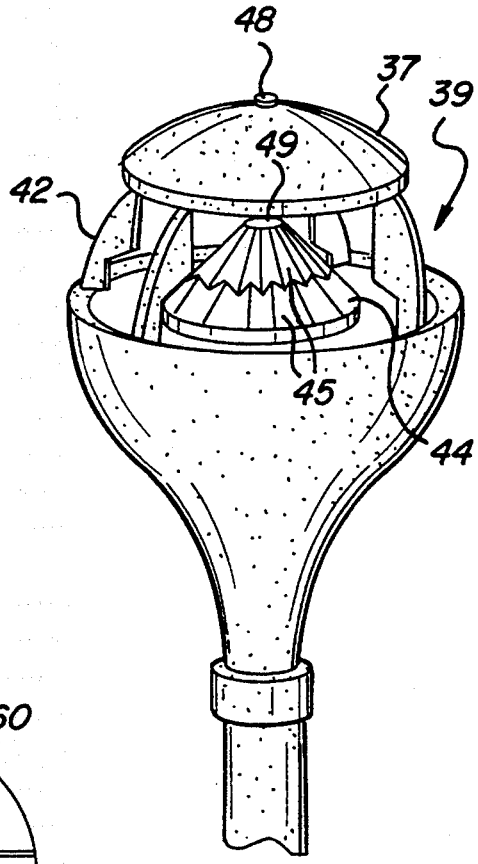
FIG. 3 shows the sensor head with the infrared transmissive collar removed to reveal certain internal features thereof.
Figure 5:
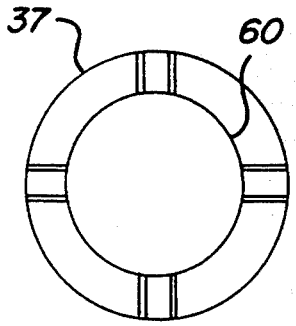
FIG. 5 is a detail view showing the inside of the top of the sensor head and showing the concave mirror.

The remote sensor 14 also includes an infrared transmissive band 39 (visible in FIG. 3) which extends around the circumference of the sensor head 36. The transmissive band 39 is covered by a collar 41 formed of an infrared transmissive material. Disposed inside the sensor head 36 is a frustoconical mirror 44 having a plurality of planar reflective surfaces 45 radially arrayed thereon. Disposed directly above the frustoconical mirror 44 is a concave mirror 60 (depicted in FIG. 5 which shows the inside of the top 37 of the sensor head 36). Thus, infrared radiation which passes through the transmissive band 39 will strike one or more of the planar surfaces 45 of frustoconical mirror 44 and be reflected upwards onto the surface of concave mirror 60. Concave mirror 60 will concentrate the radiation in its center and will reflect the focussed radiation down onto infrared sensor 49. Infrared sensor 49 may be of any conventional type such as a dual element pyroelectric type. Thus, motion within any of the 360° radius swept by the transmissive band 39 of the remote detector 14 will cause activation of the infrared detector 49. Activation of the infrared detector 49 will, in turn, cause the remote sensor 14 to transmit a radio signal of a particular frequency by means of a radio transmitter 23 disposed inside.

Figure 2:
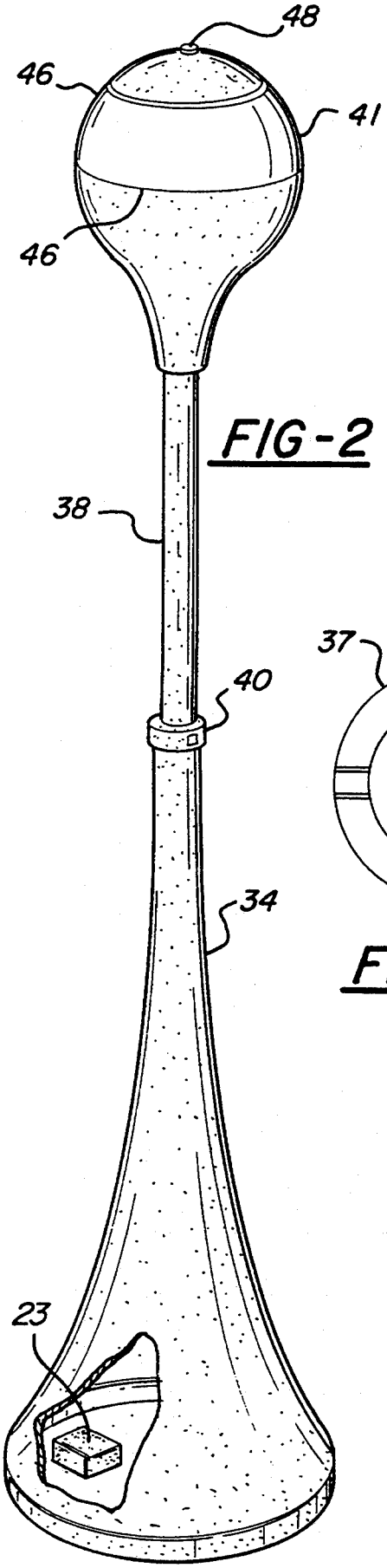
FIG. 2 shows the remote sensor of FIG. 1 with the sensor head thereof in its raised or extended position.

Masking elements 46 are provided which may be used to block off a portion of the transmissive band 39. In FIG. 2, two masking elements 46 have been used to block off the lower left quadrant of the band 39. Hence, motion occurring in any portion of the monitored space corresponding to the masked off portion of the band 39 will not activate the infrared detector 49.

It should be apparent by now that the system of the present invention allows the user great flexibility in determining the configuration of the space to be monitored. By adjusting the vertical height of the sensor head, the system can discriminate between movement occurring at a level closer to the ground (such as may be caused by small animals) or movement somewhat higher above the ground (such as may be caused by a human intruder). In fact, if the sensor head is adjusted into its highest position, false alarms caused by the movement of small household pets may be prevented. On the other hand, the system can also be used to selectively detect the intrusion of small animal predators if the system is being used to monitor such environments such as barns, chicken coops, etc. by using a remote sensor in its lowest position.

Furthermore, by using the masking elements, the user may selectively block out any movement occurring in a portion of space where regular movement is to be expected. For example, if the unit is being used to monitor a sleeping baby's room, the area surrounding the crib may be blocked off by appropriate placement of a masking unit on the sensor head so that the normal activities of the baby will not trigger the alarm.

Disposed on the underside of the base unit are a number of switches **18*a*–18*b*, as well as phone jack 21 and battery compartment 26. Switches 18*a* are mode switches; they can be used to switch the system between an install mode, and several run modes. The install mode is used during the initial set-up of the system; during installation, the user calls up a prearranged telephone number to contact the private security system. The user is then instructed to press the monitor switches 18***b* on the base console. The user then hangs up the phone to permit the private security system to directly communicate with the controller 43 of the base console and program into the unit the appropriate phone numbers to be contacted when the intrusion detector is tripped by an intrusion. After installation, the switches 18*a* may be then set to the run mode. The switches 18*a*–18*b* may also be used to switch the system between an instant and a delayed mode; in the instant mode, the system dials out to the private security system immediately when the alarm 27 trips. When set to the delayed mode, there is a 30-second delay between when the audible alarm sounds and when the system dials the central station. The switches may also be used to enable and disable other features of the system not fully described herein.

The remote control unit 16 also has a number of switches 52–58. These switches 52–58 are, typically, pressure sensitive switches which are digitally depressible by the user. Switch 58 is a "panic button" which causes audible alarm 27 in the base console to immediately activate. If the system has been armed, the base station will also dial out to the private security system. The button 56 is an instant arm button which arms the system as soon as it is pressed. When the system is armed, it activates immediately when the remote sensor 14 detects any movement. Switch 52 is a delayed arm mode which gives the user a 60-second exit delay and a 30-second entry delay. In this mode, the system arms itself 60 seconds after the button 52 is pressed. During this time, the system issues a series of count down beeps to let the user know that the system has been armed. Then, after 60 seconds, the system arms itself. Upon the detection of motion in a protected area, the base unit 12 emits a low "beep" to let the user know that it has been tripped in the delayed mode. The user then has 30 seconds to disarm the system before it activates. Button 54 is the disarm button which immediately stops the audible alarm and disarms the system. When disarmed, the base unit 12 will not sound any audible alarm and will not dial out to the private security system when motion is detected.

The base unit 12 also includes a battery compartment 26 so that the system will continue to operate even if power supplied through the power outlet cord 17 is interrupted. Remote sensor 14 and remote control unit 16 also are powered by batteries (not depicted).

Of course, one skilled in the art may depart somewhat from the depicted embodiment in designing a system according to the present invention. Thus, the system may have an exterior configuration somewhat different from that depicted; it may have fewer, more, or different features from those described with respect to the depicted embodiment. The depicted embodiment employs radio waves to communicate between the base unit, remote sensor, and remote control unit, but another type of electromagnetic radiation (such as microwave energy) could be employed. Furthermore, the exact design and arrangement of the infrared motion sensor may be other than that depicted without departing from the scope of the present invention provided that it is capable of sensing infrared radiation in a 360° arc. Thus, while the present invention has been described with reference to certain embodiments and exemplifications thereof, it is not meant to be limited to the depicted designs. Rather, it is the scope of the claims appended hereto, and all reasonable equivalents thereof which define the true scope of the invention.

I claim:

1. A remote sensor for use with an intrusion detection system of the type including a base unit having an electromagnetic wave receiver, a phone jack, a digital dialer, an external power supply plug, and a programmable controller in communication with said receiver, said jack and said dialer; said remote sensor comprising:

a base having an upwardly extending first neck portion and a spherical sensor head having a downwardly depending second neck portion for telescopic connection with said first neck portion, said remote sensor further including an electromagnetic wave transmitter for communication with said base unit, a 360° infrared motion sensor disposed in said spherical sensor head and in communication with said transmitter, and means for fixing the relative positions of said telescopic first and second neck portions such that the height of said sensor head may be adjusted along a vertical axis.

2. The sensor of claim 1 wherein said infrared motion sensor further comprises a frustoconical mirror having a plurality of planar reflection surfaces radially arranged on the surface thereof, a concave mirror disposed above said frustoconical mirror such that infrared radiation incident on said planar surfaces is reflected therefrom to fall onto said concave mirror and be concentrated thereby, and a sensor element disposed below said concave mirror such that concentrated radiation reflected from said concave mirror is reflected onto said sensor element.

3. The sensor of claim 2 wherein said spherical sensor head further includes an infrared transmissive band extending around the circumference of said sensor head at a location thereon proximate said frustoconical mirror such that infrared radiation entering said transmissive band will strike the planar surfaces of said frustoconical mirror.

4. The sensor of claim 3 wherein said sensor head further includes a collar of infrared transmissive material disposed to overlie said transmissive band and enclose said sensor head.

5. The sensor of claim 4 further including a plurality of infrared-opaque masking elements, each of said masking elements being mountable on said transmissive band so as to block infrared radiation from a selected portion of space surrounding said sensor head from striking a segment of said frustoconical mirror.

6. An intrusion detector comprising:

a base unit including an electromagnetic wave receiver, a phone jack, a digital dialer, an external power supply plug, and a programmable controller in communication with said receiver, said jack and said dialer;

at least one remote sensor including a base having an upwardly extending first neck portion and a sensor head having a downwardly depending second neck portion for telescopic connection with said first neck portion, said remote sensor further including an electromagnetic wave transmitter for communication with said base unit, a 360° infrared motion sensor disposed in said sensor head and in communication with said transmitter, and means for fixing the relative positions of said telescopic first and second neck portions such that the heights of said sensor head may be adjusted along a vertical axis; and a hand held remote control unit having an electromagnetic wave transmitter for communication with said base unit, wherein, upon sensing of motion by said infrared sensor, said transmitter transmits electromagnetic alarm signals to said receiver, said controller being programmed to dial a preselected phone number upon receipt of said signals.

7. The detector of claim 6 wherein said infrared motion sensor further comprises a frustoconical mirror having a plurality of planar reflection surfaces radially arranged on the surface thereof, a concave mirror disposed above said frustoconical mirror such that infrared radiation incident on said planar surfaces is reflected therefrom to fall onto said concave mirror and be concentrated thereby, and a sensor element disposed below said concave mirror such that concentrated radiation reflected from said concave mirror is reflected onto said sensor element.

8. The detector of claim 7 wherein said sensor head is spherical in configuration and further includes an infrared transmissive band extending around the circumference of said sensor head at a location thereon proximate said frustoconical mirror Such that infrared radiation entering said transmissive band will strike the planar surfaces of said frustoconical mirror.

9. The detector of claim 8 wherein said sensor head further includes a collar of infrared transmissive material disposed to overlie said transmissive band and enclose said sensor head.

10. The detector of claim 8 further including a plurality of infrared-opaque masking elements, each of said masking elements being mountable on said transmissive band so as to block infrared radiation from a selected portion of space surrounding said sensor head from striking a segment of said frustoconical mirror.

11. The detector of claim 6 wherein said base unit further includes audible alarm means, said controller being further programmed to activate said audible alarm means upon the activation of said infrared sensor.

12. The detector of claim 11 wherein said remote control unit further includes a digitally operable switch for transmitting an emergency signal to said base unit for activating said audible alarm means and causing said digital dialer to dial said preselected number.

13. The detector of claim 6 further comprising a plurality of remote sensor, each including an electromagnetic wave transmitter for transmitting electromagnetic radiation of a preselected frequency, the transmitter of each of said plurality of sensors transmitting at a different frequency, said receiver including a plurality of channels to identify each of said plurality of remote sensors by its characteristic frequency.

14. The detector of claim 13 wherein said base unit further includes a display unit including a plurality of LEDs, each of said plurality of remote sensors being associated with one of said plurality of LEDs, said controller being further programmed to energize the corresponding LED upon the receipt of electromagnetic radiation at the characteristic frequency from any of said plurality of remote sensors.

15. The detector of claim 6 wherein said base unit further includes a digitally operable, two position switch for switching said unit between a first, install mode, and a second, run mode.

16. The detector of claim 15 wherein said controller is further programmed, when switched to said install mode, to operate said digital dialer to dial an installation number, said controller being programmable via signals received from said installation number via said phone jack to dial said preselected number upon the activation of said infrared sensor.

17. The detector of claim 6 wherein the transmitter of the remote sensor is operative, upon the detection of motion by the infrared sensor, to transmit electromagnetic alarm signals, and the controller of the base unit is operative, upon the receipt of said alarm signals by said electromagnetic receiver, to activate said dialer to dial said preselected number.

18. The detector of claim 6 wherein said remote control unit further includes digitally depressible arming and disarming switches, said arming switch being operative to transmit an activation signal to said base unit to cause said controller to begin operation, and said disarming switches operative to send a deactivation signal to said base unit to cause said controller to cease operation.

19. An intrusion detector comprising:

a base unit including an electromagnetic wave receiver; a programmable controller in communication with said receiver; and means for indicating an alarm condition; and at least one remote sensor including a base having an upwardly extending first neck portion and a sensor head having a downwardly depending second neck portion for telescopic connection with said first neck portion, said remote sensor further including an electromagnetic wave transmitter for communication with said base unit, a 360° infrared motion sensor disposed in said sensor head and in communication with said transmitter, and means for fixing the relative positions of said telescopic first and second neck portions such that the height of said sensor head may be adjusted along a vertical axis, wherein, upon sensing of motion by said infrared sensor, said transmitter transmits alarm signals to said receiver, said controller being programmed to activate said alarm indicating means when said alarm signals are received.

20. The detector of claim 19 wherein said alarm indicating means comprises a digital dialer and phone jack in communication with said controller, said controller being programmed to cause said dialer to dial a preselected phone number upon receipt of said alarm signals.

* * * * *